United States Patent [19]

Sakai

[11] 4,219,615

[45] Aug. 26, 1980

[54] COLOR INTENSIFICATION PROCESS FOR SOUND IMAGES

[75] Inventor: Tadao Sakai, Minami-ashigara, Japan

[73] Assignee: Fuji Photo Film Co., Ltd., Minami-ashigara, Japan

[21] Appl. No.: 880,745

[22] Filed: Feb. 24, 1978

Related U.S. Application Data

[62] Division of Ser. No. 695,715, Jun. 14, 1976, abandoned.

[30] Foreign Application Priority Data

Jun. 12, 1975 [JP] Japan ..... 50-71138

[51] Int. Cl.[2] ..... G03C 7/24

[52] U.S. Cl. ..... 430/140; 430/351; 430/373; 430/423; 430/427; 430/503; 430/505; 430/936

[58] Field of Search ..... 96/4, 10, 74, 55

[56] References Cited

U.S. PATENT DOCUMENTS

| | | | |
|---|---|---|---|
| 3,342,592 | 9/1967 | Chu | 96/74 |
| 3,715,208 | 2/1973 | Lestina et al. | 96/4 |
| 3,834,907 | 9/1974 | Bissonette | 96/74 |
| 3,869,287 | 3/1975 | Sakai et al. | 96/4 |

OTHER PUBLICATIONS

Focal Encyclopedia of Photography, *Intensification*, pp. 789–790, ©1969, McGraw-Hill, N.Y., N.Y.

*Primary Examiner*—J. Travis Brown

*Attorney, Agent, or Firm*—Sughrue, Rothwell, Mion, Zinn and Macpeak

[57] ABSTRACT

A multilayer color photographic material suitable for optically recording sound images on a sound track area formed thereon is composed of a support having coated thereon at least one silver halide emulsion layer containing a color coupler in at least a 40 mol% excess of the stoichiometric amount of the coupler to the silver halide contained in the emulsion layer and at least one silver halide emulsion layer containing a color coupler in an amount less than 40 mol% excess of the stoichiometric amount of the coupler to the silver halide in the emulsion layer.

The color photographic material is suitably processed by a color intensification development process.

12 Claims, No Drawings

COLOR INTENSIFICATION PROCESS FOR SOUND IMAGES

This is a division of application Ser. No. 695,715, filed June 14, 1976.

BACKGROUND OF THE INVENTION

1. Field of the Invention

The present invention relates to a multilayer color photographic material, more specifically, the invention relates to a silver saving multilayer color photographic material having a low content of light sensitive silver halide as compared to ordinary color photographic materials. In particular, the invention relates to a silver saving multilayer color photographic material which can optically record sound images.

2. Description of the Prior Art

Various attempts have recently been proposed to conserve silver resources and to reduce the production cost of photographic materials. For example, it is known to increase the amount of dyes by subjecting the silver formed in color development to halogenation bleaching and thereafter again subject the silver halide thus formed to color development (see, e.g., U.S. Pat. Nos. 2,439,901, 2,623,822, 2,814,565, and 3,372,028).

Furthermore, various color intensification methods have been proposed as other methods of conserving the silver contained in photographic materials. For example, according to the disclosure in U.S. Pat. No. 3,674,490, the oxidation reaction is accelerated by a peroxide such as hydrogen peroxide with image-wise distributed nuclei as a catalyst to form dyes and to form color images. In this case, as the nuclei exist as a catalyst, the amount thereof may be very small, and, thus, when silver is used as such nuclei in photographic materials, the desired color density can be obtained using a far smaller amount of silver salt than in conventional gelatino silver salt emulsions. In the method of this patent, the peroxide is used in an intensification step practiced after development, or, typically, in a color development step.

On the other hand, in U.S. Pat. No. 3,765,891, a new color intensification method is described in which dye images are formed by an oxidation-reduction reaction with a cobalt(III) complex salt such as hexammine cobalt(III) chloride using image-wise distributed nuclei as a catalyst. Also, in Japanese Patent Application No. 128,327/74, there is described a method of intensifying color images by causing at least one member selected from the group consisting of a chlorite, chlorous acid, and an aqueous chlorine dioxide solution to act on image-wise distributed nuclei in the presence of a reducing agent. In this case, an alkali metal salt or an alkaline earth metal salt of chlorous acid is used as the chlorite.

According to the methods described above, when exposed silver halide emulsions containing color couplers are brought into contact with a color developing agent and an oxidizing agent as described above, such as, for example, a peroxide, a cobalt (III) complex salt, or a chlorite, the color developing agent is oxidized in the presence of silver as a catalyst and the oxidized color developing agent causes a coupling reaction with the color couplers to form dye images while the oxidizing agent is reduced.

In any case described above, since silver is present solely as a catalyst, the amount of silver may be very small, and, hence, the desired color density can be obtained using a far smaller amount of silver salt than the amount of silver salt used in conventional color photographic materials.

Accordingly, the stoichiometrically equivalent relationship which exists in the oxidation-reduction system between a color coupler and silver in conventional color photographic techniques does not exist in such new color photographic techniques as indicated above. That is, two mols or four mols of silver are required to form one mol of dye in conventional techniques, but in the case of employing the aforesaid color intensification technique, the amount of silver used may be far smaller than the aforementioned stoichiometric amount of silver. In other words, by using a larger amount of color coupler than the stoichiometric amount thereof in the case of considering silver the standard element for stoichiometric calculations, the amount of silver contained in color photographic materials can be reduced. For example, in U.S. Pat. No. 3,834,907 there is described a method of obtaining dye images having a high color density by exposing light sensitive silver salt emulsion layers containing excess color couplers, i.e., excess to the stoichiometric amounts thereof, by more than 40 mol%, preferably by more than 70 mol%, with silver as the standard element, and then bringing the exposed silver salt emulsion layers into contact with a color developing agent and an oxidizing agent such as a hexacoordinate cobalt(III) complex. In this case, the hexacoordinate cobalt(III) complex is reduced to a cobalt(II) complex by the catalytic action of the silver and at the same time dye images are formed.

However, in a color photographic material having an optical sound track (as will be explained later), such as a color reversal print film, a color reversal film, or a color print film, it is undesirable to excessively reduce the coated amount of silver of the color photographic materials to obtain the desired optical density (infrared density).

The reproduction of sound in an optical recording system for color print films, color reversal films, color reversal print films used in the field of cinema or television is performed by the steps of converting a sound signal recorded in the film as a density pattern or area pattern into a light signal, converting the light signal into an electric signal by means of a light receptor, and further converting the electric signal into a sound signal. In the sound reproducing system, photoelectric tubes possessing various optical characteristics are used as the light receptor. Among these photoelectric tubes, the most frequently used one is an S-1 type photoelectric tube having a maximum spectral sensitivity at the wavelength of about 800 mμ in the infrared region (see, e.g., Ardrin Cernwell Clyne, *Color Cinematography,* 593 (1951)).

On the other hand, in conventional color photographic materials subjected to subtractive color processing, the main absorptions of dyes formed by the coupling reaction of the oxidation product of a color developing agent (such as a p-phenylenediamine) and color couplers are all in the visible region which does not coincide with the spectral characteristics of the above indicated photoelectric tube. Therefore, if only such coupled dye images are relied upon, the sound output is weak and practically unuseable. Therefore, in order to reproduce sound in color photographic materials, the color photographic film is usually treated in a processing step in such a manner that a silver image or a silver sulfide image is formed on a sound track and the silver image or silver sulfide image thus formed in the infrared region is utilized for sound reproduction. The infrared density (transmission density) in this case is usually about 0.8 to 1.6.

The sound track in a color print film is formed by, for example, the treatment as described in the *Journal of the Society of Motion Picture and Television Engineers,* Vol. 61, 667–701 (1953).

By the method described in the aforesaid journal, the color images in the picture image areas and the sound images in the sound track areas of the color print film are simultaneously subjected to color development in a color development bath.

In a first fixing bath, unexposed silver is removed and, in a bleaching bath, developed silver in the development step is re-halogenated. In the sound development step, silver halide is converted into a silver image only in the sound track areas by selectively applying a viscous sound developer to the sound track areas. In a second fixing bath, silver halide in the image areas is fixed and removed, and, further, in a stabilization bath, dye images are stabilized. The density in the infrared region of the silver image formed on the sound track is mainly utilized for the reproduction of sound.

The sound track in reversal color print film is formed by, for example, the method as described in *Journal of the Society of Motion Picture and Television Engineers,* Vol. 76, 1198–1201 (1967). In this case, a sound image of silver is formed when the original of the sound is a negative image while a sound image of silver sulfide is formed when the original of the sound is a positive image.

In the production of sound tracks for color films, the step of forming silver or silver sulfide images is required, as stated above. The reason for forming a sound track composed of a silver image or silver sulfide image is that the spectral sensitivity characteristics of a photoelectric tube used for the reproduction of sound have a sensitivity maximum in the infrared wavelength region, but, on the other hand, dyes formed by a color development process do not have sufficient density in this wavelength region, as described before.

Therefore, in order to form an optical sound track on a color film, the film is required to contain silver therein.

In another method of forming an optical sound track containing silver on a sound recording area, a silver bleach inhibitor is applied as described in, for example, U.S. Pat. No. 3,705,803 and Japanese Patent Application (OPI) No. 24,431/74 and 87,727/73; such a method is preferably employed for forming an optical sound track on the color photographic material of this invention.

Thus, if the amount of silver in the coated layers of color photographic materials such as color reversal print films, color reversal films, color print films, etc., is excessively reduced, the optical density (infrared density) of the optical sound track formed on the color photographic material becomes insufficient.

Furthermore, when a multilayer color photographic material having an extremely reduced amount of silver in the coated emulsion layers is subjected to a color intensification development processing, sometimes the color balance of color images formed is lost by differences in coupling rates of color couplers in the emulsion layers, a development inhibition action by development inhibitor releasing compounds, etc., which results in unsatisfactory photographic characteristics.

SUMMARY OF THE INVENTION

A first object of this invention is, therefore, to provide a multilayer color photographic material which is suitable for the optical recording of sound.

A second object of this invention is to provide a multilayer color photographic material which is suitable for the optical recording of sound in spite of containing a reduced amount of silver in the silver halide emulsion layers thereof.

A third object of this invention is to provide a multilayer color photographic material which can form therein an optical sound track of excellent tone quality.

A fourth object of this invention is to provide a multilayer color photographic material which is suitable for processing by a color intensification development.

These and other objects of this invention will become clearer from the following description.

The aforesaid objects of this invention can be attained by providing, in a multilayer color photographic material, at least one light sensitive silver halide emulsion layer containing a color coupler in at least a 40 mol% excess of the stoichiometric amount of the coupler to the silver halide contained in the emulsion layer(s) and at least one light sensitive silver halide emulsion layer containing a color coupler in an amount of less than a 40 mol% excess of the stoichiometric amount of the color coupler to the silver halide contained in the emulsion layer(s).

That is, according to the present invention, there is provided a multilayer color photographic material comprising a support carrying thereon at least one silver halide emulsion layer containing a color coupler in at least a 40 mol% excess of the stoichiometric amount of the coupler based on the silver halide contained in the emulsion layer(s) and at least one silver halide emulsion layer containing a color coupler in an amount of less than a 40 mol% excess of the stoichiometric amount of the color coupler based on the silver halide in the emulsion layer(s).

DETAILED DESCRIPTION OF THE INVENTION

In one embodiment of this invention, the color photographic material comprises a support carrying thereon a first light sensitive silver halide emulsion layer having sensitivity in a wavelength region of the visible spectrum and containing a yellow dye forming color coupler, a second light sensitive silver halide emulsion layer having sensitivity in a second wavelength region of the visible spectrum and containing a cyan dye forming color coupler, and a third light sensitive silver halide emulsion layer having sensitivity in a third wavelength region of visible spectrum region and containing a magenta dye forming color coupler, although there is no particular limitation about the layer structure in this invention. In a most preferred embodiment, the first light sensitive silver halide emulsion layer has sensitivity in the wavelength region of 350 to 500 nm, the second light sensitive silver halide emulsion layer has sensitivity in the 600 to 800 nm region and the third light sensitive layer has sensitivity in the 500 to 600 nm region.

In this case, in one mode of this embodiment, the first light sensitive silver halide emulsion layer contains the color coupler in at least a 40 mol% excess of the stoichiometric amount of the coupler based on the silver halide in the emulsion layer and the second and third light sensitive silver halide emulsion layers each contains each color coupler in an amount of less than a 40 mol% excess of the stoichiometric amount of the coupler based on the silver halide in each emulsion layer.

In another mode of this embodiment, the first and second light sensitive silver halide emulsion layers each contains each color coupler in at least a 40 mol% excess of the stoichiometric amount of the coupler based on the silver halide in each emulsion layer and the third light sensitive silver halide emulsion layer contains the color coupler in an amount of less than a 40 mol% excess of the stoichiometric amount of the coupler based on the silver halide in the emulsion layer.

In still a further different mode of this embodiment, the second light sensitive silver halide emulsion layer contains the color coupler in at least a 40 mol% excess of the stoichiometric amount of the coupler based on the silver halide in the emulsion layer and the first and third light sensitive silver halide emulsion layers each contains each color coupler in an amount of less than a 40 mol% excess of the stoichiometric amount of the coupler based on the silver halide in each emulsion layer.

In another mode of this embodiment, the second and third light sensitive silver halide emulsion layers each contains each color coupler in at least a 40 mol% excess of the stoichiometric amount of the coupler based on the silver halide in each emulsion layer and the first light sensitive silver halide emulsion layer contains the color coupler in an amount of less than a 40 mol% excess of the stoichiometric amount of the coupler based on the silver halide in the emulsion layer.

The term "stoichiometric excess" is illustrated by the following example.

The molecular weight of the yellow dye forming color coupler in Example 1 was 542 and that of the silver bromide was 188. The stoichiometric equivalent of the coupler to silver bromide is $542/188 \times 4$. If the ratio by weight of the coupler to the silver bromide in the emulsion layer is greater than this value, it is present in a stoichiometric excess.

In the multilayer color photographic materials of this invention as described above, even when couplers having different coupling speeds or development inhibitor releasing compounds are used in the emulsion layers thereof, a preferred color balance and preferred photographic characteristics are obtained in color intensification development by selecting suitable combinations of the ratios of silver and color couplers. The multilayer color photographic materials as illustrated above are particularly suitable in the case of forming an optical sound track in multilayer color photographic materials.

Typically, the couplers in individual emulsion layers in various embodiments in accordance with the present invention will be different, for example, a blue light sensitive layer will contain a yellow coupler, a green light sensitive layer will contain a magenta coupler and a red light sensitive layer will contain a cyan coupler.

The optical density (infrared density) necessary for the optical sound track is about 0.8 to 1.2 in a variable density type optical sound track and about 1.0 to 1.6 in a variable area type optical sound track. A multilayer color photographic material having light sensitive silver halide emulsion layers which all contain color couplers in at least a 40 mol% excess of the stoichiometric amount of the couplers based on the silver halide contained in the emulsion layers cannot give the optical density necessary for an optical sound track due to the excessively low amount of silver in the emulsion layers.

The silver in a light sensitive silver halide emulsion layer containing a color coupler in an amount of less than a 40 mol% excess of the stoichiometric amount of the coupler based on the silver halide in the emulsion layer is mainly utilized for the reproduction of sound, and for obtaining the desired optical density for sound recording, it is desirable that the total amount of silver contained in the light sensitive silver halide emulsion layer utilized for sound reproduction be at least about 0.3 $g/m^2$, preferably at least 0.7 $g/m^2$. While not to be construed as limitative, it is highly preferred that the total amount of silver contained in the light sensitive silver halide emulsion layer utilized for sound reproduction be no more than about 3 $g/m^2$, though greater amounts can be used. Furthermore, it is also desirable that the light sensitive silver halide emulsion layer utilized for sound reproduction be disposed at the position remote the support.

In this regard, it should be noted that, for example, when one utilizes a silver saving type emulsion or a conventional type emulsion, typically the amount of coupler would be maintained constant while the amount of silver will be changed. For example, in a conventional type emulsion, if the amount of silver is 1 $g/m^2$ and the amount of coupler is 1 $g/m^2$, the weight ratio of coupler/silver is obviously 1, whereas in a silver saving type emulsion layer, if the amount of silver is 0.1 $g/m^2$ and the amount of coupler is 1 $g/m^2$, the weight ratio of coupler/silver is 10.

In one embodiment of processing these color photographic materials, the photographic material is exposed to form picture images and sound images and then processed in a color developer containing a color developing agent and an oxidizing agent to form a silver containing color image in "visual" picture image areas and a silver containing sound image in sound track areas. The photographic material is then processed in a first fix bath to remove unexposed silver halide and further processed in a bleach bath to re-halogenize the developed silver. Thereafter, a viscous sound developer is applied to the sound track areas to thereby convert only the silver halide in the sound track areas to a silver image for sound recording. The silver halide in the picture image areas is fixed and removed in a second fix bath, and, further, the dye images formed are stabilized in a stabilization bath.

In another example of processing the color photographic material of this invention, after subjecting the color photographic material to "visual" picture image exposure and sound image exposure, the photographic material is developed in a color developer containing a color developing agent and an oxidizing agent to form a silver containing color image in "visual" picture image areas and a silver containing sound image in sound recording areas. Then, a silver bleach inhibitor is selectively applied to only the sound track areas of the photographic material and thereafter the photographic material is bleached. In this case, the silver image in the sound track areas remains without being bleached by the action of the silver bleach inhibitor. The photographic material is then subjected to fixing to fix and remove the unexposed silver halide and bleached silver, and then the dye images formed are stabilized in a stabilization bath.

In any case described above, the oxidizing agent may be incorporated in the color photographic material or may be incorporated in an intensification bath employed between the development step and the first fixing step, between the first fixing step and the bleaching step, or between the development step and the blix step. The oxidizing agent may also be incorporated in a bath employed before the development step, if desired.

For forming the silver containing sound images in sound track areas, the following methods may be employed in this invention.

That is, the method of forming a sound image composed of silver by applying a viscous sound developer to the sound track areas of a multilayer color photographic material and the method of forming a sound image composed of silver sulfide by applying a sound paste to the sound track areas as described in *Journal of the Society of Motion Picture and Television Engineers,* Vol. 76, 1198–1201 (1967) and ibid., Vol. 61, 667–701 (1953), can be used.

Also, U.S. Pat. No. 3,705,803 teaches a method of forming an optical sound track by developing a multilayer color photographic material, applying a silver bleach inhibitor containing a mercapto or seleno group to the silver containing sound recording areas, and then processing the photographic material in a bleach bath; such can also be used.

Furthermore, Japanese Patent Application (OPI) No. 24,431/74 teaches a method of forming an optical sound track by color developing a multilayer color photographic material, applying to the silver containing sound recording areas a silver bleach inhibitor having a mercapto group or a silver bleach inhibitor having at least two oxyalkylene groups, and then processing the photographic material in a blix bath; such can also be used.

Still further, Japanese Patent Application No. 87,727/73 teaches a method of forming an optical sound track by color developing a multilayer color photographic material, applying a silver bleach inhibitor (which is a nitrogen containing heterocyclic compound and forms a quaternary salt by the combination of at least one of the nitrogen atoms thereof and a group having at least 6 carbon atoms) to the silver containing sound track areas, and then processing the photographic material in a bleach bath.

The above mentioned methods are all desirably utilized for forming optical sound track in the multilayer color photographic materials of this invention.

A conventional hydrophilic colloid is used for the photographic emulsion layers of the multilayer color photographic material of this invention. Examples of the hydrophilic colloid used in this invention are proteins such as gelatin, albumin, casein, etc.; cellulose derivatives such as carboxymethyl cellulose, hydroxyethyl cellulose, etc.; sugar derivatives such as agar-agar, sodium alginate, starch derivatives such as water soluble hydroxylalkylether derivatives of starch as described in U.S. Pat. No. 3,152,906, etc.; and synthetic hydrophilic colloids such as polyvinyl alcohol, poly-N-vinyl pyrrolidone, polyacrylic acid copolymers such as acrylic acid-acrylamide copolymers, polyacrylamide, and derivatives of these polymers. If desired or necessary, two or more of these colloids may be used as a mixture thereof. Among these hydrophilic colloids, gelatin is most generally used, but gelatin may be partially or wholly replaced with a synthetic polymer, e.g., by gelatin treated with a reagent having a group capable of reacting with the functional groups of the gelatin molecule, such as an amino group, imino group, hydroxy group and carboxyl group, or a graft polymer of gelatin prepared by grafting a molecular chain of another polymer onto gelatin can be used for the same purpose.

The light sensitive silver halide emulsion used in this invention is prepared by dispersing a silver halide such as silver chloride, silver bromide, silver iodide, silver chlorobromide, silver iodobromide, silver chloroiodobromide, or a mixture thereof in an aqueous solution of the aforesaid hydrophilic colloid. The silver halide emulsion may further be prepared by a conventional manner, such as, for example, an ammonia method, a neutralization method, an acid method, etc., and in this case, it is profitable to use a single jet method, a double jet method, a controlled jet method, etc. Furthermore, two or more kinds of silver halide emulsions separately prepared may be mixed to provide the silver halide emulsion used in this invention. The production of these silver halide emulsions is described in, for example, C. E. K. Mees, *The Theory of the Photographic Process,* published by Macmillan Co., and in P. Glafkides, *Photographic Chemistry,* published by Fountain Press Co.

Highly preferred silver halides for utilization in the present invention have a size of from about 0.05 to about 10$\mu$, even more preferably 0.1 to 3$\mu$, and will be dispersed in gelatin at a weight ratio of about 0.05 to 2.0 (Ag/gelatin), the silver being coated in an amount of about 0.05 to about 3.0 g/m$^2$ on the support in combination with coating gelatin in an amount of from about 0.5 to about 5.5 g/m$^2$. The crystal habit of the silver halide can vary substantially, for example, it can be of the (1,1,1) type—octahedral—of the (1,1,0) type—rhombic dodecahedral—or of the (1,0,0) type—cubic, etc.

The silver halide emulsion used in this invention may be chemically sensitized by active gelatin or by the methods as described in U.S. Pat. Nos. 1,574,944, 1,623,499, and 2,410,689, if desired. Furthermore, the silver halide emulsion used in this invention may be sensitized by a noble metal salt such as the palladium salts or gold salts described in U.S. Pat. Nos. 2,448,060, 2,399,083, and 2,642,361, if desired. Still further, if desired, the silver halide emulsion in this invention may be spectrally sensitized by a cyanine dye or merocyanine dye.

Moreover, the silver halide emulsion may be optionally subjected to spectral sensitization or super-sensitization using such cyanine dyes individually or a combination thereof with each other or with styryl dyes.

Examples of the sensitizing dyes which can be used for the light sensitive silver halide emulsions used in this invention are, for example, the blue sensitizing dyes as described in U.S. Pat. Nos. 2,493,748, 2,519,001, 2,977,229, 3,480,434, 3,672,897, 3,703,377, etc.; the green sensitizing dyes as described in U.S. Pat. Nos. 2,688,545, 2,912,329, 3,397,060, 3,615,635, 3,628,964, 3,793,020, 3,656,959, and 3,769,301; German Offenlegunsschrift Nos. 2,030,326 and 2,121,780; and Japanese Patent Publications Nos. 4936/68 and 14,030/69; and the red sensitizing dyes as described in U.S. Pat. Nos. 3,511,664, 3,615,641, 3,522,052, 3,527,641, 3,615,613, 3,615,632, 3,617,295, 3,635,721, 3,694,217, 3,743,510, and 3,617,293. These sensitizing dyes are properly selected according to the wavelength regions to be sensitized, the degree of sensitivity and the end use of the color photographic materials.

The light sensitive silver halide emulsions used in this invention may be further optionally reductively sensitized by reducing agents such as the stannous salts described in U.S. Pat. No. 2,487,850 and the polyamines described in U.S. Pat. Nos. 2,518,698 and 2,521,925.

Furthermore, the light sensitive silver halide emulsion used in this invention may be stabilized using an anti-foggant or a stabilizer, if desired. The compounds used for this purpose are, for example, azaindenes, mercaptotetrazoles, noble metal salts such as palladium salts and platinum salts; oximes, imidazoliums, and tetrazoliums as described in, for example, U.S. Pat. Nos. 2,444,605, 2,886,437, 2,403,927, 3,266,897, 3,399,987, 2,597,915, 3,566,265, and 2,694,716, and British Pat. No. 994,869.

The multilayer color photographic materials of this invention may contain conventional plasticizers such as glycerin; saponin; or coating aids as described in U.S. Pat. Nos. 3,415,649, 3,441,413, 3,502,473, 3,514,293, 3,506,449, 3,539,352, 3,545,974, 3,507,660, 3,442,654, 3,475,174, 3,462,520, 3,493,379, 3,516,833, 3,516,835, 3,589,906, 3,617,292, 3,619,199, 3,663,229, etc.

The color photographic materials of this invention may further contain conventional antistatic agents as described in U.S. Pat. Nos. 3,428,456, 3,437,484, 3,457,076, 3,549,375, 3,549,369, 3,551,152, 3,552,972, 3,547,643, 3,564,043, 3,615,531, 3,625,695, 2,131,038, 2,518,698, 3,369,904, 2,419,974 and 2,419,975 and British Pat. No. 623,448. the hydrophilic colloid used in the color photographic material of this invention may be hardened, if desired, by a hardening agent such as an aldehyde hardening agent, a methylol hardening agent, a 1,4-dioxane hardening agent, an aziridine hardening agent, an isooxazole hardening agent, a carbodiimide hardening agent, an active halogen hardening agent, and an active vinyl hardening agent. Typical examples of these hardening agents include the compounds described in U.S. Pat. Nos. 3,232,764, 3,288,775, 2,732,303, 3,635,718, 3,232,763, 2,732,316, 2,586,168, 3,103,437, 3,017,280, 2,983,611, 2,725,294, 2,725,295, 3,100,704, 3,091,537, 3,321,313, 3,543,292, 3,655,387, 3,653,906, 3,655,386, 3,686,368, 3,756,828, and 3,754,924; and British Pat. Nos. 974,723, and 1,167,207.

The color photographic materials of this invention may further contain the filter dyes or irradiation preventing dyes as described in U.S. Pat. Nos. 2,274,782, 2,527,583, 2,956,879, 3,177,078, and 3,252,021 and Japanese Patent Publication No. 22,069/64. If necessary, these dyes may be mordanted by the method as described in U.S. Pat. No. 3,282,699.

The multilayer color photographic materials of this invention may further contain ultraviolet absorbants as described in U.S. Pat. Nos. 2,415,624, 3,052,636, 3,074,971, 3,085,097, 3,067,456, 3,215,536, 2,719,086, 2,537,877, 2,784,087, 2,882,150, 2,875,053, 2,739,971, 3,097,100, 3,060,029, 2,632,701, 2,888,346, and 2,748,021.

The color photographic materials of this invention may also contain the fluorescent brightening agents as described in U.S. Pat. Nos. 3,630,738, 3,615,544, 3,586,673, and 3,434,837, and in British Pat. Nos. 1,332,475, 1,319,763, and 1,333,586.

Still further, the color photographic materials of this invention may contain the hydroquinone derivatives as described in U.S. Pat. Nos. 2,360,290, 2,336,327, 2,384,658, 2,403,721, 2,418,613, 2,675,314, 2,701,197, 2,704,713, 2,728,659, 2,732,300, and 2,735,765 as color fog preventing agents.

In the color photographic materials of this invention, various open-chain ketomethylene yellow dye forming couplers are advantageously used. Typical examples of the couplers are benzoylacetanilide couplers, pivalylacetanilide couplers, etc. Also, various pyrazolone magenta dye forming couplers, indazolone magenta dye forming couplers, etc., are advantageously used in the color photographic materials of this invention. Furthermore, various phenol cyan dye forming couplers, naphthol cyan dye forming couplers, etc., may also be used advantageously in the color photographic materials of this invention. These color couplers may have a coupling releasable group at the active carbon atom at the coupling position, if desired. It is further preferred to render the coupler non-diffusible by attaching a ballast group to the molecule of the color coupler. The terms "coupling releasable group", "ballast group", and "non-diffusible" used above are conventionally used in describing color couplers, and will be easily understood by persons skilled in the art.

To render the coupler non-diffusible, a hydrophobic group having at least 8 carbon atoms such as an alkyl group or an alkylaryl group can be introduced into the coupler molecule. Many such hydrophobic groups are known and they can be used for this purpose in this invention. The ballast group is attached to the coupler molecule directly or through an amino bond, an ether bond, a thioether bond, a carboamido bond, a sulfoamido bond, a urea bond, an ester bond, an imido bond, a carbonyl bond, a sulfonyl bond, etc.

Typical non-diffusible couplers used in this invention are illustrated below.

As yellow dye forming couplers, open-chain diketomethylene compounds are generally used, and examples of these compounds are described in U.S. Pat. Nos. 3,341,331, 2,875,057, and 3,511,155; German Offenlegungsschrift No. 1,547,868; U.S. Pat. Nos. 3,265,506, 3,582,322, and 3,725,072; German Offenlegungsschrift No. 2,162,899; U.S. Pat. Nos. 3,369,895 and 3,408,194; and in German Offenlegungsschriften Nos. 2,057,941, 2,213,461, 2,219,917, 2,261,361, and 2,263,875

As magenta dye forming couplers, 5-pyrazolone compounds are mainly used but indazolone compounds and cyanoacetyl compounds are also used. Examples of magenta dye forming couplers are described in U.S. Pat. Nos. 2,439,098, 2,600,788, 3,062,653 and 3,558,319; British Pat. No. 956,261; U.S. Pat. Nos. 3,582,322, 3,615,506, 3,519,429, 3,311,476, and 3,419,391; Japanese Patent Applications Nos. 21,454/73 and 56,050/73; German Pat. No. 1,810,464; Japanese Patent Publication No. 2,0156/69; Japanese Patent Application No. 45,971/73 and U.S. Pat. No. 2,983,608.

As cyan dye forming couplers, phenol derivatives and naphthol derivatives are mainly used, and examples of them are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, and 3,583,871; German Offenlegungsschrift No. 2,163,811; Japanese Patent Publication No. 28,836/70; and in Japanese Patent Application 33,238/73.

Still further, a DIR coupler, that is, a coupler releasing a development inhibitor at coloring or a compound releasing a development inhibitor can be added to the silver halide emulsion layer. Examples of them are described in U.S. Pat. Nos. 3,148,062, 3,227,554, 3,253,924, 3,617,291, 3,622,328 and 3,705,201; British Pat. No. 1,201,110; U.S. Pat. Nos. 3,297,445, 3,379,529, and 3,639,417; and in Japanese Patent Applications Nos. 33,238/73 and 41,870/73.

Two or more kinds of the aforesaid couplers may be incorporated in the same silver halide emulsion layer or the same kind of coupler may be incorporated in more than two silver halide emulsion layers to satisfy the characteristics required for the color photographic materials.

The couplers, etc., may be added to a hydrophilic colloid for a phtographic material by any known manner as described in, for example, U.S. Pat. No. 2,322,027. In general, the coupler is dissolved in a high boiling point organic solvent (having a boiling point of higher than about 180° C.), e.g., a phthalic acid alkyl ester such as methyl phthalate, ethyl phthalate, propyl phthalate, n-butyl phthalate, di-n-butyl phthalate, n-amyl phthalate, isoamyl phthalate, and dioctyl phthalate; an alkylamide such as N,N-diethyllaurylamide; a trimellitate ester such as tri-tert-octylmellitate; a phosphoric acid ester such as polyphenyl phosphate, tricresyl phosphate, dioctylbutyl phosphate, etc.; or a citric acid ester such as acetyltributyl citrate or a low boiling point organic solvent (having a boiling point of about 30° to 150° C.), e.g., a lower alkyl acetate such as ethyl acetate and butyl acetate; ethyl propionate; sec-butyl alcohol; methyl isobutyl ketone; β-ethoxyethyl acetate; methyl cellosolve acetate; etc., and the solution of the dye dispersed in a photographic hydrophilic colloid. The aforesaid high boiling point organic solvent and the low boiling point organic solvent may be, if desired, used as a mixture thereof.

Also, when the coupler possesses an acid group such as a carboxylic acid or sulfonic acid group, the coupler can be introduced into the hydrophilic colloid as an alkaline aqueous solution of the coupler.

The photographic support on which the photographic hydrophilic colloid layers of this invention are formed includes supports as are usually used for conventional photographic materials, such as cellulose nitrate films, cellulose acetate films, cellulose acetate butyrate films, cellulose acetate propionate films, polystyrene films, polyethylene terephthalate films, polycarbonate films, and laminates of these polymer films. When the adhesion between the support and a photographic emulsion layer is insufficient, a layer having good adhesion to both layers may be formed on the support as a subbing layer, and to further improve the adhesion of the surface of the support, the surface may be subjected to a pre-treatment such as a corona discharging, ultraviolet irradiation, flame treatment, etc.

To obtain dye images of the color photographic material of this invention, the photographic material is exposed and processed according to color processing steps. The main processing steps include, fundamentally, a color development, a bleach, and a fix. In this case, two or more such steps may sometimes be performed in one step using a processing solution having the functions thereof; one example thereof is a blix solution. Furthermore, if desired or necessary, each step may be divided into two or more steps or a combination of a color development, a first fix, and a blix can be employed. In addition, a pre-hardening, a neutralization, a first development (black and white development), an image stabilization, a washing, etc., may be employed in addition to the aforesaid fundamental steps in the development procedure.

The preferred processing temperature is selected depending on the kind of color photographic material to be processed and the formats of the processing solutions. The temperature is sometimes lower than 18° C. but is usually higher than 18° C. In particular, a temperature of 20° to 60° C. is most usually employed. Recently, processing temperatures of 30° to 60° C. have usually been employed. In addition, the processing steps in a series of development process need not always be at the same temperature, though in continuous processing such is often convenient.

The color developer is an alkaline aqueous solution having a pH higher than 8, preferably of 9 to 12, and containing a developing agent, that is, a compound the oxidation product of which forms a colored compound upon reaction with a color coupler.

The aforesaid color developing agent is a compound having a primary amino group on the aromatic ring thereof and having the function of developing exposed silver halide or a precursor which can form such a compound. Examples of the developing agent are 4-amino-N,N-diethylaniline, 3-methyl-4-amino-N,N-diethylaniline, 4-amino-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino3-methoxy-N,N-diethylaniline, 4-amino-3-methyl-N-ethyl-N-βmethoxyethylaniline, 4-amino-3-methoxy-N-ethyl-N-β-methoxyethylaniline, 4-amino-4-β-methanesulfoamidoethyl-N,N-diethylaniline, and the salts (e.g., sulfates, hydrochlorides, sulfites, p-toluenesulfonates, etc.) thereof. Other examples of these compounds are described in U.S. Pat. Nos. 2,193,015 and 2,592,364; Japanese Patent Application(OPI) No. 64,933/73 and L. F. A. Mason, *Photographic Processing Chemistry,* 226–229 (1966) published by Focal Press, London. The above mentioned compounds may be used together with a 3-pyrazolidone, if desired. If desired or necessary, the color developer may contain various conventional additives.

Examples of additives often employed in color developers are an alkaline agent (e.g., hydroxides, carbonates, and phosphates of an alkali metal or ammonium), a pH controlling agent or a buffer (e.g., a weak acid such as acetic acid and boric acid, a weak base, and the salts thereof), a development accelerator (e.g., the pyridinium compounds and the cationic compounds as described in U.S. Pat. Nos. 2,638,604 and 3,671,247; potassium nitrate and sodium nitrate; the polyethylene glycol condensates and the derivatives thereof as described in U.S. Pat. Nos. 2,533,990, 2,577,127 and 2,950,970; nonionic compounds such as the polythioethers as described in British Pat. Nos. 1,020,033 l and 1,020,032; polymers having a sulfite ester group as described in U.S. Pat. No. 3,068,097; pyridine, ethanolamine, benzyl alcohol; and hydrazine), and anti-foggant (e.g., an alkali bromide; an alkali iodide; the nitrobenzimidazoles as described in U.S. Pat. Nos. 2,496,940 and 2,656,271; mercaptobenzimidazole; 5-methylbenztriazole; 1-phenyl-5-mercaptotetrazole; the compounds for rapid processing as described in U.S. Pat. Nos. 3,113,864, 3,342,596, 3,295,976, 3,615,522, and 3,597,199; the thiosulfonyl compounds as described in British Pat. No. 972,211; the phenazine-N-oxides as described in Japanese Patent Publication No. 41,675/71; and the anti-foggants as described in *Kagaku Shashin Binran* (*Handbook of Scientific Photography*), Vol. 2, pages 28–47); the stain preventing agents or the sludge preventing agents as described in U.S. Pat. Nos. 3,161,513, and 3,161,514; and British Pat. Nos. 1,030,442, 1,144,481, and 1,251,558, the interimage effect promoting agents as described in U.S. Pat. No. 3,536,487, and preservatives (e.g., sulfites, acid sulfites, hydroxylamine hydrochlorides, formaldehyde-sulfite adducts, alkanolamine-sulfite adducts, etc.).

The bleach solution usually contains a known bleach gent such as potassium ferricyanide, dichromates, iron(III) compounds, etc. Also, the oxidizing agent for silver used in an ordinary bleaching solution can be used in the bleach bath of this invention. For example, a water soluble ferricyanide (sodium ferricyanide, potassium ferricyanide, ammonium ferricyanide, etc.), a water soluble quinone (quinone, chloroquinone, methylquinone, etc.), a water soluble ferric salt (ferric chloride, ferric sulfate, ferric thiocyanide, ferric oxalate, etc.), a water soluble cupric salt (cupric chloride, cupric nitrate, etc.), or a water soluble cobaltic salt (cobaltic chloride, cobaltic ammonium nitrate, etc.) can be used. Furthermore, multivalent cations and alkali metal complex salts of water soluble organic acids may be used.

Typical examples of such organic acids are malonic acid, tartaric acid, ethylmalonic acid, malic acid, fumaric acid, diglycolic acid, thioglycolic acid, ethyliminodipropionic acid, nitrilotriacetic acid, ethylenediaminetetraacetic acid, aminotriacetic ethylenedithioglycolic acid, dithioglycolic acid, etc.

Examples of such multivalent cations are ferric ions, cobaltic ions, cupric ions, etc. The iron-sodium complex salt of ethylenediaminetetraacetic acid is particularly useful as the bleaching agent.

Practical examples of bleach solutions are described in, for example, *Journal of the Society of Motion Picture and Television Engineers,* Vol. 61, 667–701 (1953); U.S. Pat. Nos. 3,189,452 and 3,582,322; German Pat. Nos. 866,605 and 966,410; and *British Journal of Photography,* Vol. 107, 122–123 and 126 (1966).

A fix solution is used to remove soluble silver salt(s) from the photographic materials. The fix solution usually contains a solvent for silver halide. Preferred examples of the silver halide solvent are, for example, a water soluble thiosulfate (sodium thiosulfate, potassium thiosulfate, ammonium thiosulfate, etc.), a water soluble thiocyanide (sodium thiocyanide, potassium thiocyanide, ammonium thiocyanide, etc.), a water soluble organic diol containing an oxygen atom or sulfur atom (e.g., 3-thia-1,5-pentanediol, 3,6-dithia-1,8-octanediol, 9-oxa-3,6,12,15-tetrathia-1,17-heptanediol, etc.), a water soluble sulfur containing organic dibasic acid, water soluble salts of such dibasic acids (e.g., ethylenebisthioglycolic acid and the sodium salt thereof, etc.), and an imidazolidinethion (e.g., methylimidazolidinethion, etc.).

Also, the fixing agents as described in L. F. A. Mason, *Photographic Processing Chemistry,* 187–188 (1966), published by Focal Press, can be advantageously used in this invention.

Furthermore, if desired or necessary, the bleach step and the fix step may be performed in one bath. This bath is usually called a "blix bath" and practical examples of the blix bath are described in German Pat. No. 866,605 and U.S. Pat. No. 3,582,322.

Each of the processing baths described above is advantageously used repeatedly after the bath is regenerated. Typical regeneration processes are described in, for example, *Journal of the Society of Motion Picture and Television Engineers,* Vol. 81, 293–295 (1972).

Silver is advantageously recovered from the used fix solution. Such a silver recovery system is described in, for example, *Journal of the Society of Motion Picture and Television Engineers,* Vol. 81, 603–608 (1972).

In the case of processing a low silver content multilayer color photographic material having a very low content of light sensitive silver halide as compared with ordinary color photographic materials, after exposure, an intensification development process is applied to the color photographic material in the color development processing for forming color images. Such a color intensification development process is disclosed in, for example, Japanese Patent Application No. 128,327/74 and Japanese Patent Applications (Laid Open) Nos. 9,729/73, 6,338/72 and 10,538/72. That is, when an oxidizing agent is contacted with image-wise metallic silver, the oxidative power of the oxidizing agent increases by the catalytic action of the silver to oxidize the aromatic primary amino color developing agent and the oxidation product of the color developing agent thus formed causes a coupling reaction with color couplers to form an azomethine dye or indoaniline dye and thus form a dye image.

Such an oxidizing agent may be incorporated in a photographic emulsion layer (e.g., in a light sensitive silver halide emulsion layer and a non-light sensitive photographic auxiliary layer such as an interlayer, etc., typically in an amount of from about 0.05 to about 4 mol/l mol of silver; see Japanese Patent Application (OPI) No. 76,101/74 and German Patent Application (OLS) No. 2,357,695), but is usually incorporated in a color developer bath or an intensification bath which is used before or after color development. When such an oxidizing agent is added to a color developer bath, most preferably it is added in an amount of not less than about 0.2 mol/liter, and when it is added to an intensification bath most preferably it is added in an amount of not less than about 0.25 mol/liter.

Other examples of the color intensification methods employable in this invention are described in, for example, U.S. Pat. No. 3,674,490; British Pat. No. 1,341,719; U.S. Pat. Nos. 3,761,265, 3,776,739, 3,765,890, and 3,817,751; German Offenlegungsschrift No. 2,226,770; U.S. Pat. Nos. 3,748,138, 3,765,891, 3,834,907, 3,822,129, and 3,847,619; German Offenlegungsschrift No. 2,357,695; Belgian Pat. No. 807,568; German Offenlegungsschrifts Nos. 2,357,694 and 2,360,326; U.S. Pat. Nos. 3,862,855, 3,841,873 and 3,846,130.

The specific oxidizing agents used for the color intensification development in this invention are described in, for example, Japanese Patent Application No. 128,327/74 and in Japanese Patent Applications (Laid Open) Nos. 9,729/73, 6,338/72, and 10,538/72. Examples of preferred oxidizing agents for color intensification development are Co(III) complex salts (e.g., $[Co(NH_3)_5H_2O]X$, $[Co(NH_3)_5Co_3]X$, $[Co(NH_3)_5Cl]X$, $[Co(NH_3)_4Co_3]X$, $[Co(en)_3]X$, $cis[Co(en)_2(N_3)_2]X$, $trans[Co(en)_2Cl(NCS)]X$, $trans[Co(en)_2(N_3)_2]X$, $cis[Co(en)_2(NH_3)N_3]X$, cis and trans- $[Co(en)_2Cl_2]X$, $[Co(en)_2(SCN)_2]X$, $[Co(en)_2(NCS)_2]X$, $[Co(trien)_3]X$, $[Co(trien)_2(en)]X$, and $[Co(trien)(en)_2]X$, wherein "en" represents ethylenediamine, "trien" represents triethylenediamine, and X represents at least one anion such as $Br^-$, $Cl^-$, $NO_2^-$, $ClO_4^-$, $CH_3^-$, $COO^-$, $CO_3^{--}$, $SO_3^{--}$, $SO_4^{--}$, $NO_3^-$, $SCN^-$, $OH^-$, etc., which is so selected that the charge of the salt is neutralized by the anion(s)); chlorites (e.g., sodium chlorite, potassium chlorite, ammonium chlorite, etc.); inorganic peroxides (e.g., peroxycarbonates, peroxysilicates, peroxyphosphates, peroxysulfates, hydrogen peroxide, etc.); organic peroxides (e.g., benzoyl peroxide, etc.); addition compounds of hydrogen peroxide and organic compounds, e.g., an addition compound of hydrogen peroxide and urea (e.g., perhydrated carbamide); an addition product of hydrogen peroxide and an acid amide such as organic acid amides, e.g., acetanilide; an addition product of hydrogen peroxide and a polyhydroxy compound, e.g., gallic acid; and an addition product of hydrogen peroxide and an amine, e.g., sulfamic acid.

The invention will be illustrated in more detail by the following Examples. In the following Examples, all percentages are weight percentages, except as otherwise indicated.

EXAMPLE 1

A subbing layer was formed on a cellulose triacetate film support having on the opposite surface an antihalation layer containing black and white carbon black and then the following photographic layers were successively coated on the subbing layer. Samples I, II, and III of silver halide multilayer color photographic films as shown in Table I were thus prepared.

first layer: Blue sensitive layer
second layer: Interlayer (1)
third layer: Red sensitive layer
fourth layer: Interlayer (2)
fifth layer: Green sensitive layer
sixth layer: Protective layer In this Example, the green sensitive layer contained 30 mol% Br, the red sensitive layer contained 70 mol% Br, and the blue sensitive layer contained 70 mol% Br; the crystal size of the silver halide in each emulsion layer was 1$\mu$.

The couplers in the blue sensitive layer, the red sensitive layer, and the green sensitive layer had the following structures. Each coupler was dissolved in a mixture of dibutyl phthalate and ethyl acetate, the solution was dispersed by emulsification in an aqueous gelatin solution, and then the dispersion was added to each silver halide emulsion. Yellow dye forming color coupler:

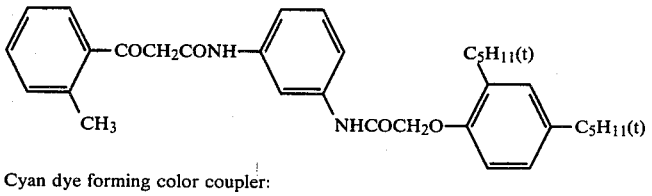

Cyan dye forming color coupler:

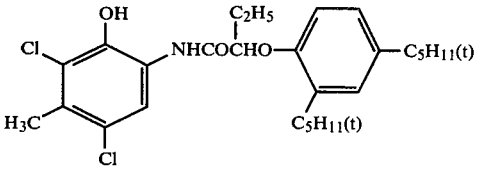

Magenta dye forming coupler:

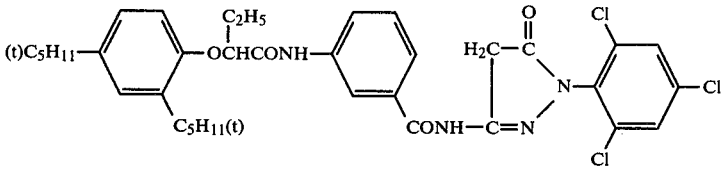

Also, the spectral sensitizing dye used in the red sensitive silver halide emulsion layer and the spectral sensitizing dye used in the green sensitive silver halide emulsion layer are shown below together with the addition amount thereof (per mol of silver). Spectral sensitizing dye for red sensitive layer:

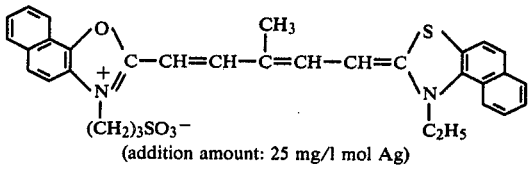

(addition amount: 25 mg/l mol Ag)

Spectral sensitizing dye for green sensitive layer:

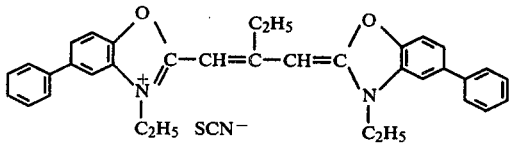

(addition amount: 250 mg/l mol Ag)

The protective layer as the sixth layer was formed by coating a coating composition prepared by dispersing liquid paraffin in an aqueous gelatin solution.

The amounts of silver, couplers, and gelatin in the photographic emulsion layers of each sample are shown in the following table.

TABLE 1

| Sample | | Silver (g/m²) I | Silver (g/m²) II | Silver (g/m²) III | Coupler (g/m²) I | Coupler (g/m²) II | Coupler (g/m²) III | Gelatin (g/m²) I | Gelatin (g/m²) II | Gelatin (g/m²) III |
|---|---|---|---|---|---|---|---|---|---|---|
| First layer | Blue sensitive layer | 1.2 | 0.6 | 0.6 | 1.2 | 1.2 | 1.2 | 3.0 | 3.0 | 3.0 |
| Second layer | Interlayer | — | — | — | — | — | — | 0.8 | 0.5 | 0.5 |
| Third layer | Red sensitive layer | 0.6 | 0.1 | 0.1 | 1.0 | 0.9 | 0.9 | 1.8 | 1.8 | 1.8 |
| Fourth layer | Interlayer | — | — | — | — | — | — | 0.8 | 0.5 | 0.5 |
| Fifth layer | Green sensitive layer | 1.1 | 0.15 | 1.0 | 1.5 | 0.9 | 0.9 | 3.0 | 2.0 | 2.0 |

TABLE 1-continued

| Sample | | Silver ($g/m^2$) I | II | III | Coupler ($g/m^2$) I | II | III | Gelatin ($g/m^2$) I | II | III |
|---|---|---|---|---|---|---|---|---|---|---|
| Sixth layer | Protective layer | — | — | — | — | — | — | 0.7 | 0.7 | 0.7 |

Each of samples I to III was step-wise exposed through a silver wedge using a tungsten lamp having a color temperature of 2854° K. as a light source (corresponding to image forming exposure). Apart from this, other sets of samples I to III were image-wise exposed through a silver wedge and a yellow filter using a tungsten lamp having a color temperature of 2854° K. (corresponding to sound image forming exposure). For both the picture image and sound image exposure, the intensity was 100,000 lux, the time was 1/100 second and the amount of exposure was 1,000 CMS. The samples thus subjected to image forming exposure were processed and then the color densities (blue density, green density, and red density) in the visible region measured. In processing, the following processing A or B was performed except that sound development only was omitted. On the other hand, the samples subjected to sound image forming exposure were processed by the following processing A or B. The latter samples were used to measure the silver density in the infrared wavelength region after processing. The color densities (blue density, green density, and red density) of each sample film in the visible region were measured using a Fuji type self recording densitometer. The silver density in infrared wavelength region was measured by means of a Macbeth TD-206A type densitometer using a Status S-58 filter. The results obtained are shown in Table 2.

| Processing A | | | |
|---|---|---|---|
| Step | Temperature | Time | |
| Pre-bath | 27° C. | | 10 sec |
| Wash | 27° C. | | 15 sec |
| Color development | 27° C. | 5 min | 20 sec |
| Wash | 27° C. | | 15 sec |
| First fix | 27° C. | 1 min | |
| Wash | 27° C. | | 40 sec |
| Bleach | 27° C. | 3 min | |
| Wash | 27° C. | 1 min | |
| Sound development | Room temperature | | 15 sec |
| Wash | 27° C. | | 15 sec |
| Second fix | 27° C. | 2 min | |
| Wash | 27° C. | 5 min | |
| Stabilize | 27° C. | | 10 sec |

The compositions of the processing baths used in the above processing were as follows:

| | | |
|---|---|---|
| Pre-bath | | |
| Water | 800 | ml |
| Sodium carbonate (monohydrate) | 10.0 | g |
| Sodium sulfate (anhydrous) | 50.0 | g |
| Water to make | 1.0 | l |
| Color developer | | |
| Water | 80.0 | ml |
| Sodium hexametaphosphate | 2.0 | g |
| Anhydrous sodium sulfite | 4.0 | g |
| 2-Amino-5-diethylaminotoluene hydrochloride | 3.0 | g |
| Sodium carbonate (monohydrate) | 25.0 | g |
| Potasium bromide | 2.0 | g |
| Water to make | 1.0 | l |
| First fix solution (second fix solution) | | |

-continued

| | | |
|---|---|---|
| Water | 600 | ml |
| Sodium thiosulfate . $5H_2O$ | 240 | g |
| Anhydrous sodium sulfite | 15.0 | g |
| Glacial acetic acid | 12.0 | g |
| Boric acid | 6.0 | g |
| Potassium alum | 15.0 | g |
| Water to make | 1 | l |
| Bleach solution | | |
| Water | 800 | ml |
| Potassium bromide | 20.0 | g |
| Potassium dichromate | 5.0 | g |
| Potassium alum | 40.0 | g |
| Sodium acetate ($3H_2O$) | 3.0 | g |
| Glacial acetic acid | 10.0 | g |
| Water to make | 1.0 | l |
| Sound developer | | |
| (Solution A) | | |
| Water | 600 | ml |
| Anhydrous sodium sulfite | 40.0 | g |
| N-Methyl-p-aminophenol sulfate | 40.0 | g |
| Sodium hydroxide | 40.0 | g |
| Hydroquinone | 40.0 | g |
| (Solution B) | | |
| Water | 300 | ml |
| Tragacanth gum | 5.0 | g |
| Denatured alcohol | 10 | ml |
| (Solution C) | | |
| Ethylenediamine (70%) | 20 | ml |

At the preparation of the sound developer, Solution A was mixed with Solution B, and, directly before use, Solution C and water were added to the mixture to make 1.0 liter of total solution.

| Stabilization bath | | |
|---|---|---|
| Water | 800 | ml |
| Formalin (37%) | 10 | ml |
| Aqueous solution of 40% polyethylene glycol (molecular weight 400) | 5 | ml |
| Water to make | 1.0 | l |

PROCESSING B

The steps and the compositions of the processing solutions were same as those in processing A except that a color developer having the following composition was used in Process B.

| Color developer-intensifier | | |
|---|---|---|
| Water | 800 | ml |
| Anhydrous sodium sulfite | 40 | g |
| 4-Amino-N-ethyl-N-β-hydroxyethyl-aniline sulfate | 20 | g |
| 1-Phenyl-3-pyrazolidone | 0.1 | g |
| Potassium bromide | 0.5 | g |
| Ethylenediamine tetraacetic acid tetra-sodium salt | 6 | g |
| $[CO[NH_3)_6]Cl_3$ | 2.5 | g |
| Borax | 10 | g |
| Water to make | 1 | l |
| | pH 11.0 | |

TABLE 2

| Sample | I | II | II | III | III |
|---|---|---|---|---|---|
| Processing | A | A | B | A | B |
| Blue density | 3.8 | 2.1 | 3.9 | 2.1 | 3.9 |
| Green density | 3.6 | 1.0 | 3.6 | 3.3 | 3.7 |
| Red density | 3.9 | 1.0 | 3.8 | 1.0 | 3.7 |
| Infrared density | 1.8 | 0.4 | 0.5 | 1.5 | 1.8 |

As is clear from the results in Table 2, Sample I having a high silver content gave high visible densities (color density) and high infrared density by the application of Processing A, while Sample II having a low silver content gave low visible densities by the application of Processing A but gave high color densities by the application of Processing B in which the color developer contained the oxidizing agent of this invention. However, the infrared density was low in both processings. On the other hand, Sample III which belongs to the photographic materials of this invention gave high visible density and high infrared density by the application of Processing B.

While the invention has been described in detail and with reference to specific embodiments thereof, it will be apparent to one skilled in the art that various changes and modifications can be made therein without departing from the spirit and scope thereof.

What is claimed is:

1. A process for forming picture and sound images on a multilayer color photographic material which comprises exposing a multilayer color photographic material comprising a support carrying thereon, in succession, a blue sensitive silver halide emulsion layer containing a yellow dye forming color coupler in at least 40 mol% excess of the stoichiometric amount of the coupler to the silver halide in the emulsion layer, a red sensitive silver halide emulsion layer containing a cyan dye forming color coupler in at least 40 mol% excess of the stoichiometric amount of the coupler to the silver halide in the emulsion layer, and a green sensitive silver halide emulsion layer containing a magenta dye forming coupler in an amount less than 40 mol% excess of the stoichiometric amount of the coupler to the silver halide in the emulsion layer in that order, and thereafter developing picture and sound images on said photographic material using said three emulsion layers, by a color intensification development.

2. A process for forming picture and sound images on a multilayer color photographic material which comprises exposing a multilayer color photographic material comprising a support carrying thereon, in succession, a blue sensitive silver halide emulsion layer containing a yellow dye forming color coupler in at least 40 mol% excess of the stoichiometric amount of the coupler to the silver halide in the emulsion layer, a red sensitive silver halide emulsion layer containing a cyan dye forming color coupler in an amount less than 40 mol% excess of the stoichiometric amount of the coupler to the silver halide in the emulsion layer, and a green sensitive silver halide emulsion layer containing a magenta dye forming color coupler in an amount less that 40 mol% excess of the coupler to the silver halide in the emulsion layer in that order, and thereafter developing picture and sound images on said photographic material using said three emulsion layers, by color intensification development.

3. A process for forming picture and sound images on a multilayer color photographic material which comprises exposing a color photographic material comprising a support carrying thereon, in succession, a blue sensitive silver halide emulsion layer containing a yellow dye forming color coupler in at least 40 mol% excess of the stoichiometric amount of the coupler to the silver halide in the emulsion layer, a red sensitive silver halide emulsion layer containing a cyan dye forming color coupler in at least 40 mol% excess of the stoichiometric amount of the coupler to the silver halide in the emulsion layer, and a green sensitive silver halide emulsion layer containing a magenta dye forming coupler in an amount less than 40 mol% excess of the stoichiometric amount of the coupler to the silver halide in the emulsion layer in that order, and thereafter contacting an oxidizing agent with image-wise metallic silver formed by a color development to form picture and sound images on said photographic material using said three emulsion layers.

4. A process for forming picture and sound images on a multilayer color photographic material which comprises exposing a multilayer color photographic material comprising a support carrying thereon, in succession, a blue sensitive silver halide emulsion layer containing a yellow dye forming color coupler in at least 40 mol% excess of the stoichiometric amount of the coupler to the silver halide in the emulsion layer, a red sensitive silver halide emulsion layer containing a cyan dye forming color coupler in an amount less than 40 mol% excess of the stoichiometric amount of the coupler to the silver halide in the emulsion layer, and a green sensitive silver halide emulsion layer containing a magenta dye forming coupler in an amount less than 40 mol% excess of the coupler to the silver halide in the emulsion layer in that order, and thereafter contacting an oxidizing agent with imagewise metallic silver formed by a color development to form picture and sound images on said photographic material using said three emulsion layers.

5. The process of claim 1 including the additional steps of fixing, bleaching, sound development and fixing.

6. The process of claim 2 including the additional steps of fixing, bleaching, sound development and fixing.

7. The process of claim 1 including the additional steps of bleach inhibiting, bleaching and fixing.

8. The process of claim 2 including the additional steps of bleach inhibiting, bleaching and fixing.

9. The process of claim 7 wherein said bleaching and said fixing are conducted in a mono-bath system.

10. The process of claim 8 wherein said bleaching and said fixing are conducted in a mono-bath system.

11. The process of claim 1 in which the total amount of silver in the silver halide emulsion layer containing a color coupler in an amount of less than 40 mol% excess of the stoichiometric amount of the coupler to the silver halide is at least 0.3 $g/m^2$.

12. The process of claim 2 in which the total amount of silver in the silver halide emulsion layer containing a color coupler in an amount of less than 40 mol% excess of the stoichiometric amount of the coupler to the silver halide is at least 0.3 $g/m^2$.

* * * * *